US011166507B2

(12) United States Patent
Parker-Austin

(10) Patent No.: US 11,166,507 B2
(45) Date of Patent: Nov. 9, 2021

(54) GARMENT LENGTH ADJUSTER

(71) Applicant: Rosetta Parker-Austin, Augusta, GA (US)

(72) Inventor: Rosetta Parker-Austin, Augusta, GA (US)

( * ) Notice: Subject to any disclaimer, the term of this patent is extended or adjusted under 35 U.S.C. 154(b) by 0 days.

(21) Appl. No.: 15/448,588

(22) Filed: Mar. 2, 2017

(65) Prior Publication Data

US 2017/0273378 A1 Sep. 28, 2017

Related U.S. Application Data

(60) Provisional application No. 62/313,892, filed on Mar. 28, 2016.

(51) Int. Cl.
*A41F 15/00* (2006.01)
*A44B 11/04* (2006.01)

(52) U.S. Cl.
CPC ..... *A41F 15/002* (2013.01)

(58) Field of Classification Search
CPC ... A41F 15/002; A44B 11/04; Y10T 24/4093; Y10T 24/4088
See application file for complete search history.

(56) References Cited

U.S. PATENT DOCUMENTS 685,831 A * 11/1901 Frawley ..... F16L 33/02 24/200
701,259 A * 5/1902 De Haven ..... B65D 63/08 24/23 B
881,461 A * 3/1908 Craig et al. ..... A44B 11/04 24/198
2,113,795 A * 4/1938 Marshall ..... A41F 15/002 2/73
2,224,773 A * 12/1940 Shaulson ..... A44B 11/28 24/198
2,260,060 A * 10/1941 Shaulson ..... A44B 11/04 24/200
2,849,773 A * 9/1958 Kaselow ..... A41F 9/025 2/221
3,075,268 A * 1/1963 Schwartz ..... A41F 15/002 24/200
3,177,541 A * 4/1965 Derrickson ..... A44B 11/04 24/200
3,267,490 A * 8/1966 Wallace ..... A41F 15/002 2/323
4,922,582 A * 5/1990 Flanigan ..... A44B 11/065 24/71.1
4,941,434 A * 7/1990 Ellwanger ..... A01K 27/005 119/771

(Continued)

*Primary Examiner* — Robert Sandy
*Assistant Examiner* — Rowland Do
(74) *Attorney, Agent, or Firm* — Charlena Thorpe, Esq.; Incorporating Innovation LLC

(57) ABSTRACT

Implementations of a garment length adjuster are provided. In some implementations, the garment length adjuster comprises a frame defining an interior opening and a plurality of elongated projections having a gap between adjacent projection or a projection and side where each projection extends from a first side toward second opposite side within the interior opening. In some implementations, the garment length adjuster is used to adjust the length of a garment by routing one or more straps of the garment over thought one or more gaps and one or more projections of the garment length adjuster.

13 Claims, 4 Drawing Sheets

(56) References Cited

U.S. PATENT DOCUMENTS 6,546,601 B1 * 4/2003 Kawashima ..... A44B 11/04
24/197
7,631,399 B2 * 12/2009 Soumi ..... H02G 11/00
24/115 K

* cited by examiner

GARMENT LENGTH ADJUSTER

CROSS REFERENCE TO RELATED APPLICATION

This application claims the benefit of U.S. Patent Application Ser. No. 62/313,892, which was filed on Mar. 28, 2016, and is incorporated herein by reference in its entirety.

TECHNICAL FIELD

This disclosure relates to implementations of a garment length adjuster.

BACKGROUND

Many people purchase or otherwise obtain clothing (e.g., shirts, dresses, etc.) that is too long. To alter the length of such clothing, some people choose to take the clothing to a tailor to adjust the length. However, tailors are often expensive and time-consuming to use for such alterations. Other people choose to wear such clothing without altering the clothing to fit, which can give the clothing a frumpy, disheveled, or otherwise unappealing or undesirable appearance.

DETAILED DESCRIPTION

Implementations of a garment length adjuster are provided. In some implementations, the garment length adjuster comprises a frame defining an interior opening and a plurality of elongated projections having a gap between adjacent projections and between a projection and an adjacent side, where each projection extends from a first side toward a second opposite side within the interior opening. In some implementations, the garment length adjuster is used to adjust the length of a garment by routing one or more straps of the garment through one or more of the gaps and over and under one or more of the projections of the garment length adjuster.

Figure 1A:
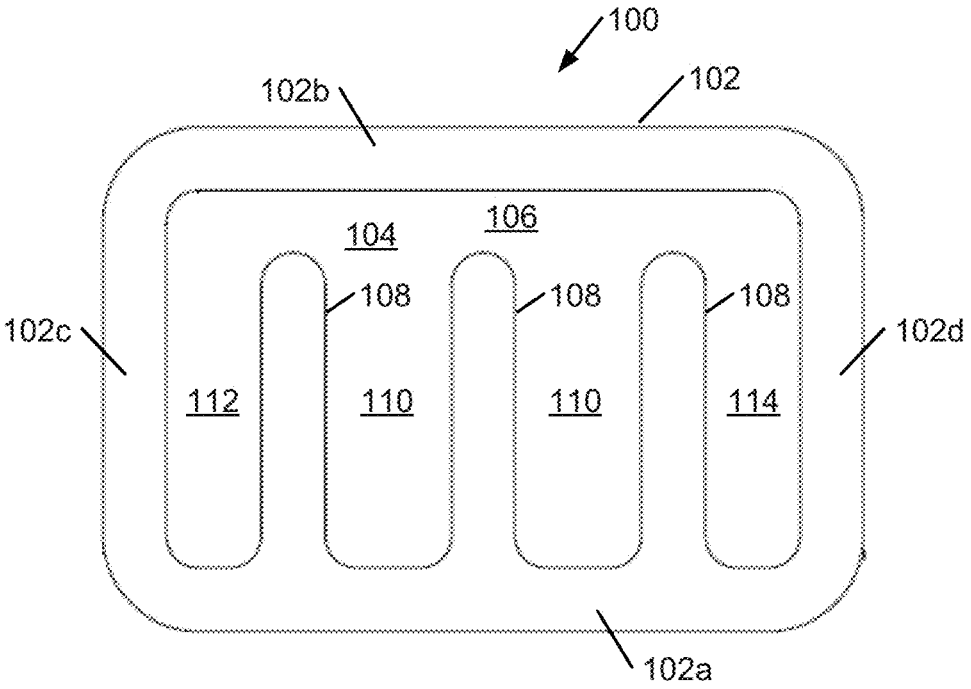
FIGS. 1A and 1B illustrate an example garment length adjuster according to the present disclosure.
Figure 1B:
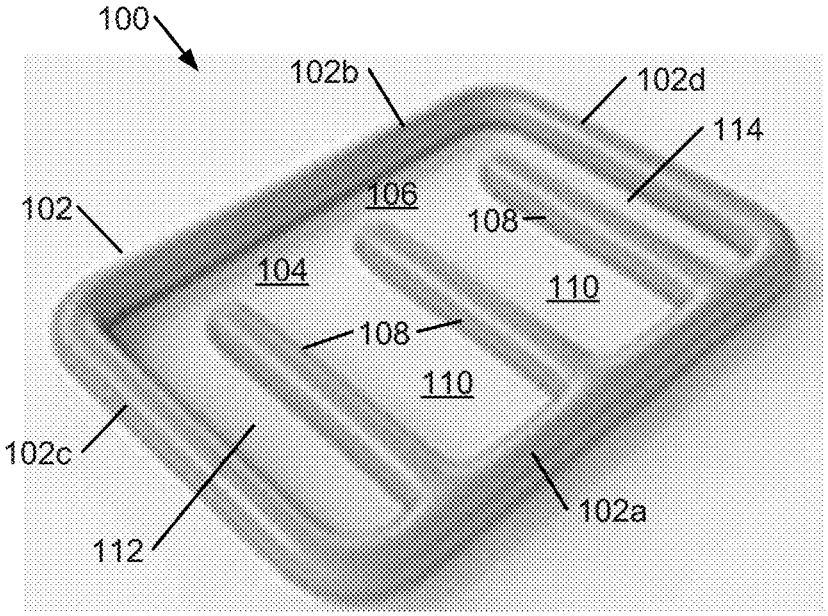

FIGS. 1A and 1B illustrate a top and perspective view, respectively, of an example garment length adjuster 100 according to the present disclosure. In some implementations, the garment length adjuster 100 comprises a frame 102 defining an interior opening 104 and a plurality of elongated projections 108.

In some implementations, the frame 102 comprises a first elongated side 102*a* having a first end and a second end, a second elongated side 102*b* having a first end and a second end, where the second elongated side 102*b* is opposite the first elongated side 102*a*, a third elongated side 102*c* having a first end and a second end, and a fourth elongated side 102*d* having a first end and a second end, where the fourth elongated side 102*d* is opposite the third elongated side 102*c*.

In some implementations, the first elongated side 102*a* extends from the first end of the third elongated side 102*c* to the first end of the fourth elongated side 102*d*. In some implementations, the second elongated side 102*b* extends from the second end of the third elongated side 102*c* to the second end of the fourth elongated side 102*d*.

In some implementations, the first elongated side 102*a*, second elongated side 102*b*, third elongated side 102*c*, and fourth elongated side 102*d* form a closed interior opening 104.

In some implementations, the first elongated side 102*a*, second elongated side 102*b*, third elongated side 102*c*, and fourth elongated side 102*d* form a rectangular shape. In some implementations, the first elongated side 102*a*, second elongated side 102*b*, third elongated side 102*c*, and fourth elongated side 102*d* form a rectangular shape with curved edges. In some implementations, the first elongated side 102*a*, second elongated side 102*b*, third elongated side 102*c*, and fourth elongated side 102*d* form a square shape. In some implementations, the first elongated side 102*a*, second elongated side 102*b*, third elongated side 102*c*, and fourth elongated side 102*d* form any other suitable shape to implement a garment length adjuster according to the present disclosure.

In some implementations, the first elongated side 102*a* and the second elongated side 1002*b* are longer than the third elongated side 102*c* and the fourth elongated side 102*d*. In some implementations, the first elongated side 102*a* and the second elongated side 102*b* are the same length as the third elongated side 102*c* and the fourth elongated side 102*d*.

In some implementations, each of the plurality of elongated projections 108 extend width-wise across the garment length adjuster 100 from one side of the frame 102, inside the interior opening 104, and toward an opposite side of the frame 102. In some implementations, each of the plurality of elongated projections 108 extend width-wise across the garment length adjuster 100 from the first side 102*a* of the frame 102, inside the interior opening 104, and toward the second side 102*b* of the frame 102.

In some implementations, the garment length adjuster 100 comprises a gap 106 between the ends of the elongated projections 108 and the opposite second side 102*b* of the frame 102.

In some implementations, the plurality of projections 108 are spaced apart lengthwise across the garment length adjuster 100 thereby creating a gap 110 between the projections 108. In some implementations, the plurality of projections 108 are equally spaced apart lengthwise across the garment length adjuster 100.

In some implementations, the garment length adjuster 100 comprises a gap 112 between the third side 102*c* and the nearest projection 108. In some implementations, the garment length adjuster 100 comprises a gap 114 between the fourth side 102*d* and the nearest projection 108.

In some implementations, the garment length adjuster 100 comprises three elongated projections 108. In some implementations, the garment length adjuster 100 comprises less than three elongated projections 108. In some implementations, the garment length adjuster 100 comprises more than three elongated projections 108.

In some implementations, the garment length adjuster 100 may be made from a metal. In some implementations, the garment length adjuster 100 may be made from a plastic. In some implementations, the garment length adjuster 100 may be made from any other suitable material to implement the garment length adjuster 100 according to the present disclosure.

In some implementations, the garment length adjuster 100 may have a length in the range of 0.75 inches to 1.50 inches. In some implementations, the garment length adjuster 100 may have a length less than 0.75 inches. In some implementations, the garment length adjuster 100 may have a length greater than 1.5 inches.

In some implementations, the garment length adjuster 100 may have a width in the range of 0.50 inches to 1.00 inch. In some implementations, the garment length adjuster 100 may have a width less than 0.50 inches. In some implementations, the garment length adjuster 100 may have a width greater than 1.00 inch.

In some implementations, the garment length adjuster 100 may have a depth or thickness in the range of 0.06 inches to 0.13 inches. In some implementations, the garment length adjuster 100 may have a depth or thickness less than 0.06 inches. In some implementations, the garment length adjuster 100 may have a depth or thickness greater than 0.13 inches.

In some implementations, the projections 108 may have a length in the range of 0.38 inches to 0.75 inches. In some implementations, the projections 108 may have a length less than 0.38 inches. In some implementations, the projections 108 may have a length greater than 0.75 inches.

In some implementations, the projections 108 may have a separation or spacing in the range of 0.19 inches to 0.38 inches. In some implementations, the projections 108 may have a separation or spacing less than 0.19 inches. In some implementations, the projections 108 may have a separation or spacing greater than 0.38 inches.

In some implementations, the garment length adjuster 100 may be used to adjust the length of a garment strap (e.g., a shoulder strap). In some implementations, the gaps 110, 112, 114 and projections 108 of the garment length adjuster 100 may be used to reduce the length of a garment strap. In some implementations, the garment straps may be routed through one or more gaps 110, 112, 114 of the garment length adjuster 100 to reduce the distance from one end of a strap to another end of the strap. In some implementations, the amount of reduction may be based on which gaps 110, 112, 114 are used to route a strap.

Figure 2A:
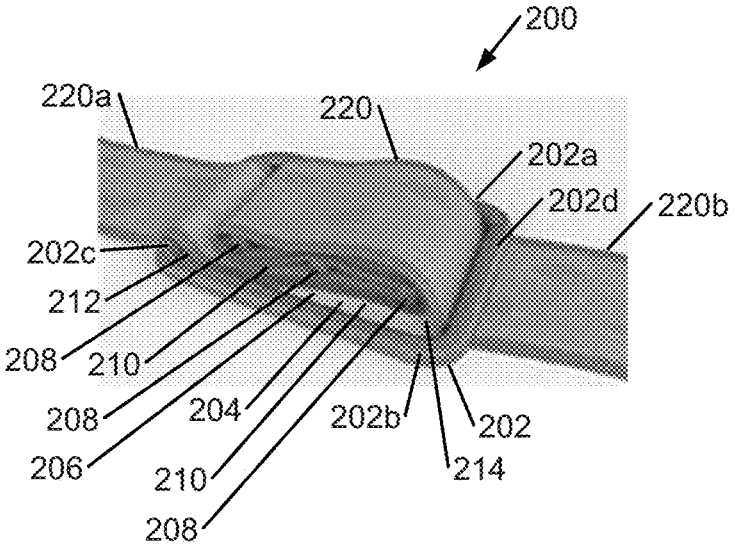
FIGS. 2A, 2B, 2C, 2D, 2E, and 3 illustrate various example methods of using a garment length adjuster according to the present disclosure.

FIG. 2A illustrates an example method of using a garment length adjuster 200 to reduce the length of a strap 220 according to the present disclosure. As shown in FIG. 2A, a garment length adjuster 200 according to the present disclosure is used to reduce the distance between the first end 220*a* of a garment strap 220 and a second end 220*b* of the strap 220.

In some implementations, the garment length adjuster 200 comprises a frame 202 defining an interior opening 204 and a plurality of elongated projections 208.

In some implementations, the frame 202 comprises a first elongated side 202*a* having a first end and a second end, a second elongated side 202*b* having a first end and a second end, where the second elongated side 202*b* is opposite the first elongated side 202*a*, a third elongated side 202*c* having a first end and a second end, and a fourth elongated side 202*d* having a first end and a second end, where the fourth elongated side 202*d* is opposite the third elongated side 102*c*.

In some implementations, the first elongated side 202*a* extends from the first end of the third elongated side 202*c* to the first end of the fourth elongated side 202*d*. In some implementations, the second elongated side 202*b* extends from the second end of the third elongated side 202*c* to the second end of the fourth elongated side 202*d*.

In some implementations, the first elongated side 202*a*, second elongated side 202*b*, third elongated side 202*c*, and fourth elongated side 202*d* form a closed interior opening 204.

In some implementations, the elongated projections 208 are the same as the elongated projections 108 described above.

In some implementations, the garment length adjuster 200 comprises a gap 212 between the third side 202*c* and the nearest projection 208. In some implementations, the garment length adjuster 200 comprises a gap 214 between the fourth side 102*d* and the nearest projection 108.

In some implementations, the garment length adjuster 200 is the same as the garment length adjuster 100 describe above.

To reduce the distance between the first end 220*a* of a garment strap 220 and a second end 220*b* of the strap 220, generally a portion of the strap 220 between the first end 220*a* and the second end 220*b* is routed through gaps 210, 212, 214 of the garment length adjuster 200.

More specifically, a portion of the strap 220 between the first end 220*a* and the second end 220*b* is inserted in the interior 204 of the adjuster 200 through the gap 206 between the ends of the plurality of projections 208 and the second side 202*b* of the adjuster 200.

The strap 220 is routed through the adjuster 200 by positioning the strap 220 over the third side 202*c*, then down through the gap 212 between the third side 202*c* and the nearest projection 208 to the third side 202*c*. The strap 220 then is routed toward the fourth side 202*d* under the plurality of projections 208 and then up through the gap 214 between the fourth side 202*d* and the nearest projection 208 to the fourth side 202*d*.

The strap 220 then is routed toward the third side 202*c* over two projections 208 and then down through the gap 220 between the closet two adjacent projections 208. The strap 220 then is routed toward the third side 202*c* under the projections 208 closest to the third side 202*c*. The strap 220 then is routed up through the gap 212 between the third side 202*c* and the nearest projection 208 to the third side 202*c*.

The strap 220 then is routed toward the fourth side 202*d* over the plurality of projections 208 and then down through the gap 214 between the fourth side 202*d* and the nearest projection 208 to the fourth side 202*d*. The strap 220 then is routed under the forth side 202*d*.

In this way, the length of the garment strap 220 may be reduced and may provide a better fit or appearance of a garment when worn. Furthermore, the use of alterations or a tailor may be avoided.

In some implementations, the strap 220 may be tightened about the projections by pulling on the first side 220*a* and/or the second side 220*b* of the strap.

Figure 2B:
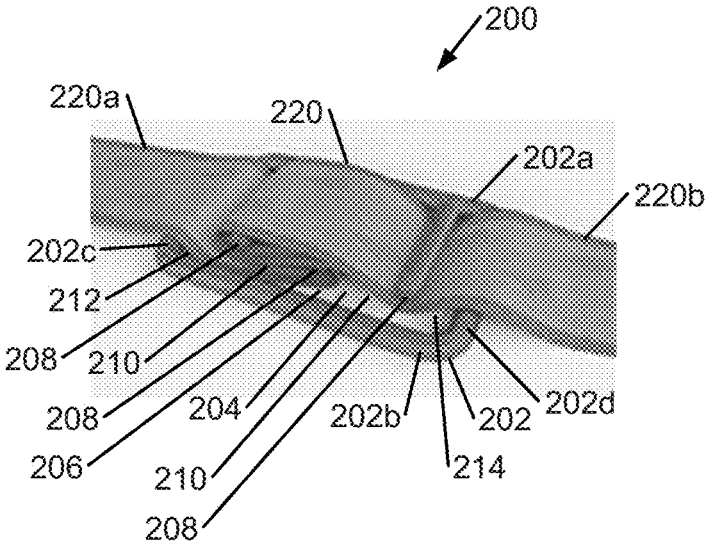

FIG. 2B illustrates another example method of using a garment length adjuster 200 to reduce the length of a strap 220 according to the present disclosure.

As shown in FIG. 2B, a portion of the strap 220 between the first end 220*a* and the second end 220*b* is inserted in the interior 204 of the adjuster 200 through the gap 206 between the ends of the plurality of projections 208 and the second side 202*b* of the adjuster 200.

The strap 220 is routed through the adjuster 200 by positioning the strap over the third side 202*c*, then down through the gap 212 between the third side 202*c* and the nearest projection 208 to the third side 202*c*. The strap 220 then is routed toward the fourth side 202*d* under two of the projections 208 and then up through the gap 210 between the closest two adjacent projections.

The strap 220 then is routed toward the third side 202*c* over one projection 208 and then down through the gap 210 between the closest two adjacent projections. The strap 220 then is routed toward the third side 202*c* under the projections 208 closest to the third side 202*c*. The strap 220 then is routed up through the gap 212 between the third side 202*c* and the nearest projection 208 to the third side 202*c*.

The strap 220 then is routed toward the fourth side 202*d* over two projections 208 and then down through the gap 210 between the closest two adjacent projections 208. The strap 220 then is routed under the projection 208 closest to the forth side 202*d*. The strap 220 is then routed up through the gap 214 between the fourth side 202*d* and the nearest projection 208 to the fourth side 202*d*. The strap 220 then is routed over the fourth side 202*d*.

Figure 2C:
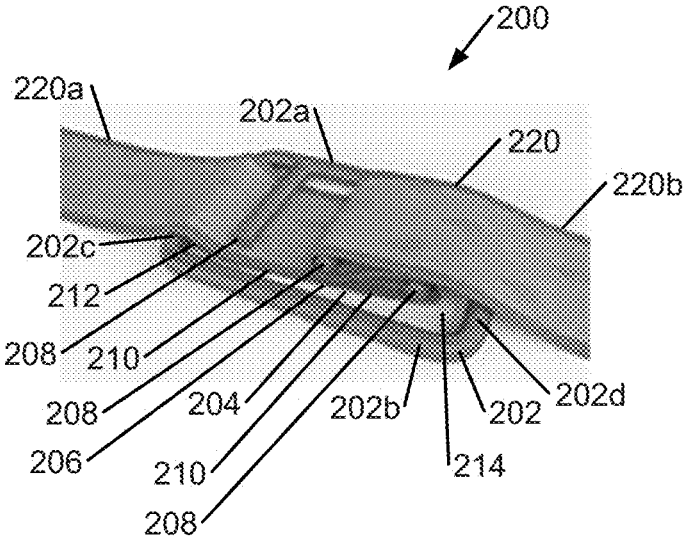

FIG. 2C illustrates another example method of using a garment length adjuster 200 to reduce the length of a strap according to the present disclosure.

As shown in FIG. 2C, a portion of the strap 220 between the first end 220*a* and the second end 220*b* is inserted in the interior 204 of the adjuster 200 through the gap 206 between the ends of the plurality of projections 208 and the second side 202*b* of the adjuster 200.

The strap 220 is routed through the adjuster 200 by positioning the strap 220 over the third side 202*c*, then down through the gap 212 between the third side 202*c* and the nearest projection 208 to the third side 202*c*. The strap 220 then is routed toward the fourth side 202*d* under the plurality of projections 208 and then up through the gap 214 between the fourth side 202*d* and the nearest projection 208 to the fourth side 202*d*.

The strap 220 then is routed toward the third side 202*c* over one projection 208 and then down through the gap 210 between the nearest two adjacent projections 208. The strap 220 then is routed toward the third side 202*c* under one projection 208. The strap 220 then is routed up through the gap 210 between the nearest two adjacent projections 208. The strap 220 then is routed toward the fourth side 202*d* over the two projections 208 and over the forth side 202*d*.

Figure 2D:
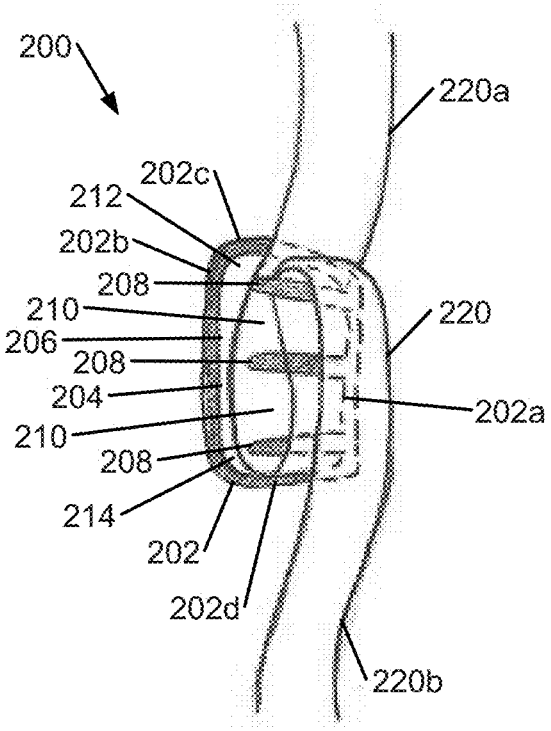

FIG. 2D illustrates another example method of using a garment length adjuster 200 to reduce the length of a strap 220 according to the present disclosure. The method illustrated in FIG. 2D is similar to the method of FIG. 2A except that the step of routing strap 220 under the forth side 202*d* is omitted.

Figure 2E:
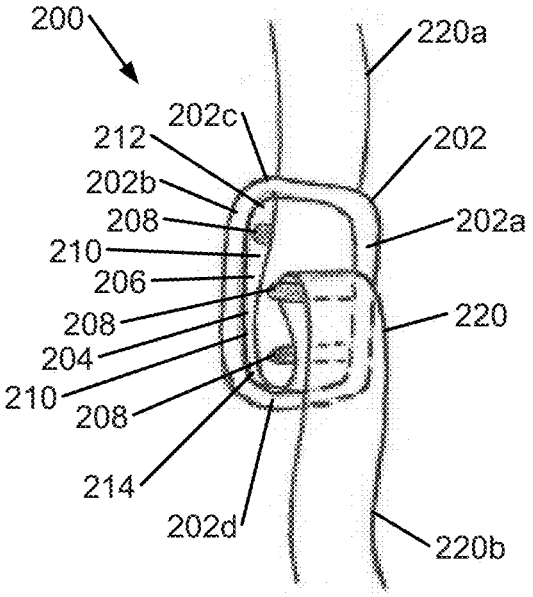

FIG. 2E illustrates another example method of using a garment length adjuster 200 to reduce the length of a strap 220 according to the present disclosure. The method illustrated in FIG. 2E is similar to the method of FIG. 2C except that the strap 220 is initially routed under the third side 202*c* and up through the gap 212 between the third side 202*c* and the projection 208 closest to the third side 202*c*. The strap 220 then is routed toward the fourth side 202*d* over one projection 208 and down through the gap 210 between the nearest two adjacent projections 208. The strap 220 is then routed as described with respect to FIG. 2C.

As illustrated in FIGS. 2A-E, the distance between the first end 220*a* of a garment strap 220 to a second end 220*b* of the strap 220 may be reduced by inserting a portion of the strap 220 between the first end 220*a* and the second end 220*b* in the interior 204 of the adjuster 200 through the gap 206 between the ends of the plurality of projections 208 and the second side 202*b* of the adjuster 200 and routing the strap 220 down through a gap (e.g., gap 212 or 210), then routing the strap from the third side 202*c* of the adjuster 200 toward the fourth side 202*d* of the adjuster 200 under one or more of the projections 208, then routing the strap 220 up through a gap (e.g., gap 210, or 214), then routing the strap 220 back toward the third side 202*c* of the adjuster 200 over one or more of the projections 2058, and then routing the strap 220 down through a gap (e.g., gap 210, 212), then routing the strap 220 back toward to the fourth side 202*d* of the adjuster 200 over one or more projections 208. The extent to which the strap 220 is routed toward the third side 202*c* and fourth side 202*d* determines the amount of reduction in the strap 220 achieved.

Furthermore, as exemplified in FIGS. 2A-E, the strap 220 can be routed in any of various ways through the gaps 210, 212, 214, over and under the projections 208 and/or frame 202 to adjusts the length of the strap 220 and thereby the corresponding garment or to achieve a different look.

Figure 3:
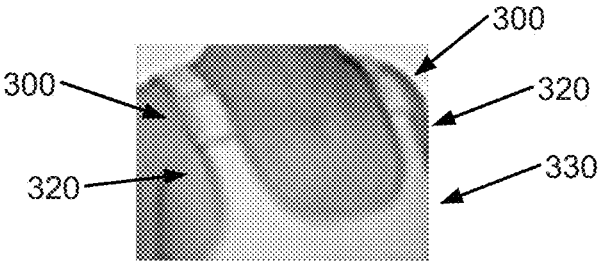

FIG. 3 illustrates an example method of adjusting a garment 330 using an adjuster 300 according to the present disclosure. To adjust the garment, one or both of the shoulder straps 320 on the garment may be adjusted. To adjust a strap 320, a portion of the strap 320 of the garment is inserted and routed through an adjuster 300 according to the present disclosure.

Reference throughout this specification to "an embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

Many modifications and other embodiments of the inventions set forth herein will come to mind to one skilled in the art to which these inventions pertain having the benefit of the teachings presented in the foregoing descriptions and the associated drawings.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

While operations are depicted in the drawings in a particular order, this should not be understood as requiring that such operations be performed in the particular order shown or in sequential order, or that all illustrated operations be performed, to achieve desirable results.

The invention claimed is:

1. A garment length adjuster, comprising:

a frame defining an interior opening wherein the frame comprises a first elongated side extending lengthwise having a first end and a second end wherein the first elongated side is straight with no depressions and a first outermost side, a second elongated side extending lengthwise having a first end and a second end where the second elongated side is opposite the first side wherein the second elongated side is straight with no depressions and a second outermost side opposite the first outermost side, a third elongated side extending widthwise having a first end and a second end wherein the third elongated side is a third outermost side, and a fourth elongated side extending widthwise having a first end and a second end where the fourth elongated side is opposite the third side wherein the fourth elongated side is a fourth outermost side opposite the third outermost side, wherein the first elongated side extends from the first end of the third elongated side to the first end of the fourth elongated side and the second elongated side extends from the second end of the third elongated side to the second end of the fourth elongated side and wherein the first elongated side, second elongated side, third elongated side, and fourth elongated side form a closed, interior opening; and a plurality of elongated projections, wherein for each projection, the projection comprises a first end and a second end wherein the second end is not tapered and not bent and the projection extends widthwise from the first end to the second end within the interior opening from the first elongated side toward the second elongated side along a line and a gap extends widthwise from the second end of the projection to the second elongated side along the line and wherein the plurality of projections are spaced apart lengthwise across the garment length adjuster thereby creating a gap between adjacent projections and wherein the garment length adjuster comprises a gap between the third elongated side and the nearest projection and a gap between the fourth elongated side and the nearest projection such that the garment length adjuster comprises an opening extending widthwise between the ends of the elongated projections and the second elongated side of the frame and a continuous opening lengthwise between the third elongated side and the fourth elongated side of the frame.

2. The garment length adjuster of claim 1 wherein the garment length adjuster comprises three elongated projections.

3. The garment length adjuster of claim 1 wherein the garment length adjuster has a length in the range of 0.75 inches to 1.50 inches, a width in the range of 0.50 inches to 1.00 inch, and a thickness in the range of 0.06 inches to 0.13 inches.

4. The garment length adjuster of claim 3 wherein each of the projections have a length in the range of 0.38 inches to 0.75 inches and the gap between adjacent projections is in the range of 0.19 inches to 0.38 inches.

5. The garment length adjuster of claim 4 wherein the frame is rectangular with rounded corners.

6. A method of reducing the distance between a first end of a strap to a second end of the strap using a garment length adjuster wherein the garment length adjuster comprises a frame defining an interior opening wherein the frame comprises a first elongated side extending lengthwise having a first end and a second end, a second elongated side extending lengthwise having a first end and a second end where the second elongated side is opposite the first side, a third elongated side extending widthwise having a first end and a second end, and a fourth elongated side extending widthwise having a first end and a second end where the fourth elongated side is opposite the third side, wherein the first elongated side extends from the first end of the third elongated side to the first end of the fourth elongated side and the second elongated side extends from the second end of the third elongated side to the second end of the fourth elongated side, wherein the first elongated side, second elongated side, third elongated side, and fourth elongated side form a closed, interior opening; and wherein the garment length adjuster comprises a plurality of elongated projections wherein each of the projections extend widthwise within the interior opening from the first elongated side toward the second elongated side, wherein the garment length adjuster comprises a gap between the ends of the elongated projections and the second elongated side of the frame and wherein the plurality of projections are spaced apart lengthwise across the garment length adjuster thereby creating a gap between adjacent projections and wherein the garment length adjuster comprises a gap between the third elongated side and the nearest projection and a gap between the fourth elongated side and the nearest projection such that the garment length adjuster comprises an opening extending widthwise between the ends of the elongated projections and the second elongated side of the frame and lengthwise between the third elongated side and the fourth elongated side of the frame, the method comprising:

inserting a portion of the strap between the first end and the second end of the strap in the interior opening of the garment length adjuster through the gap between the ends of the plurality of projections and the second elongated side of the adjuster; and then routing the portion of the strap from the third elongated side toward the fourth elongated side through one or more gaps and under and over one or more projections.

7. The method of claim 6 wherein routing the strap from the third elongated side toward the fourth elongated side through one or more gaps and under and over one or more projections comprises:

routing the strap down through a gap and then routing the strap from the third elongated side of the adjuster toward the fourth elongated side of the adjuster under one or more of the projections;

then routing the strap up through a gap and then routing the strap back toward the third side of the adjuster over one or more of the projections, and then routing the strap down through a gap and then routing the strap back toward to the fourth side of the adjuster over one or more projections.

8. The method of claim 6 wherein routing the strap from the third elongated side toward the fourth elongated side through one or more gaps and under and over one or more projections comprises:

positioning the strap over the third side of the adjuster and then routing the strap down through the gap between the third side of the adjuster and the nearest projection to the third side of the adjuster;

then routing the strap toward the fourth side of the adjuster under the plurality of projections and then routing the strap up through the gap between the fourth side of the adjuster and the nearest projection to the fourth side of the adjuster;

then routing the strap toward the third side of the adjuster over one or more projections and then down through the gap between the closest two adjacent projections;

then routing the strap toward the third side of the adjuster under one or more projections;

then routing the strap up through the gap between the third side of the adjuster and the nearest projection to the third side of the adjuster; and then routing the strap toward the fourth side of the adjuster over the plurality of projections.

9. The method of claim 8, further comprising then routing the strap down through the gap between the fourth side of the adjuster and the nearest projection to the fourth side and then routing the strap under the fourth side of the adjuster.

10. The method of claim 6 wherein routing the strap from the third elongated side toward the fourth elongated side through one or more gaps and under and over one or more projections comprises:

positioning the strap over the third side of the adjuster and then down through the gap between the third side of the adjuster and the nearest projection to the third side of the adjuster;

then routing the strap toward the fourth side of the adjuster under one or more of the projections and then up through the gap between the closest two adjacent projections;

then routing the strap toward the third side of the adjuster over one or more projections and then down through the gap between the closest two adjacent projections;

then routing the strap toward the third side of the adjuster under one or more projections and then routing the strap up through the gap between the third side of the adjuster and the nearest projection to the third side;

then routing the strap toward the fourth side of the adjuster over one or more projections and then down through the gap between the closest two adjacent projections;

then routing the strap under one or more projections and then routing the strap up through the gap between the fourth side of the adjuster and the nearest projection to the fourth side of the adjuster; and then routing the strap over the fourth side of the adjuster.

11. The method of claim 6 wherein routing the strap from the third elongated side toward the fourth elongated side through one or more gaps and under and over one or more projections comprises:

positioning the strap over the third side of the adjuster and then down through the gap between the third side of the adjuster and the nearest projection to the third side of the adjuster;

then routing the strap toward the fourth side of the adjuster under the plurality of projections and then up through the gap between the fourth side of the adjuster and the nearest projection to the fourth side of the adjuster;

then routing the strap toward the third side of the adjuster over one or more projection and then down through the gap between the closets two adjacent projections;

then routing the strap toward the third side of the adjuster under one or more projections and then routing the strap up through the gap between the closest two adjacent projections; and then routing the strap toward the fourth side of the adjuster over one or more projection.

12. The method of claim 6 wherein routing the strap from the third elongated side toward the fourth elongated side through one or more gaps and under and over one or more projections comprises:

positioning the strap over the third side of the adjuster and then down through the gap between the third side of the adjuster and the projection closet to the third side of the adjuster;

then routing the strap toward the fourth side of the adjuster over one or more projections and down through the gap between the nearest two adjacent projections;

then routing the strap toward the fourth side of the adjuster under one or more projections and then up through the gap between the fourth side of the adjuster and the nearest projection to the fourth side of the adjuster;

then routing the strap toward the third side of the adjuster over one or more projection and then down through the gap between the closets two adjacent projections;

then routing the strap toward the third side of the adjuster under one or more projections and then routing the strap up through the gap between the closest two adjacent projections; and then routing the strap toward the fourth side of the adjuster over one or more projection.

13. A method of adjusting a garment using a garment length adjuster wherein the garment length adjuster comprises a frame defining an interior opening wherein the frame comprises a first elongated side extending lengthwise having a first end and a second end, a second elongated side extending lengthwise having a first end and a second end where the second elongated side is opposite the first side, a third elongated side extending widthwise having a first end and a second end, and a fourth elongated side extending widthwise having a first end and a second end where the fourth elongated side is opposite the third side, wherein the first elongated side extends from the first end of the third elongated side to the first end of the fourth elongated side and the second elongated side extends from the second end of the third elongated side to the second end of the fourth elongated side, wherein the first elongated side, second elongated side, third elongated side, and fourth elongated side form a closed, interior opening; and wherein the garment length adjuster comprises a plurality of elongated projections wherein each of the projections extend widthwise within the interior opening from the first elongated side toward the second elongated side, wherein the garment length adjuster comprises a gap between the ends of the elongated projections and the second elongated side of the frame and wherein the plurality of projections are spaced apart lengthwise across the garment length adjuster thereby creating a gap between adjacent projections and wherein the garment length adjuster comprises a gap between the third elongated side and the nearest projection and a gap between the fourth elongated side and the nearest projection such that the garment length adjuster comprises an opening extending widthwise between the ends of the elongated projections and the second elongated side of the frame and lengthwise between the third elongated side and the fourth elongated side of the frame, the method comprising:

adjusting one or more shoulder straps of a garment by inserting and routing a portion of the strap from the third elongated side toward the fourth elongated side through one or more gaps and under and over one or more projections.

* * * * *